US011021823B2

(12) United States Patent
Takaki

(10) Patent No.: US 11,021,823 B2
(45) Date of Patent: Jun. 1, 2021

(54) PERFORATING APPARATUS AND EMBROIDERY SEWING MACHINE WITH THE PERFORATING APPARATUS

(71) Applicant: TOKAIKOGYO MISHIN KABUSHIKI KAISHA, Aichi (JP)

(72) Inventor: Hirofumi Takaki, Aichi (JP)

(73) Assignee: TOKAIKOGYO MISHIN KABUSHIKI KAISHA, Aichi (JP)

( * ) Notice: Subject to any disclaimer, the term of this patent is extended or adjusted under 35 U.S.C. 154(b) by 75 days.

(21) Appl. No.: 16/345,654

(22) PCT Filed: Nov. 13, 2017

(86) PCT No.: PCT/JP2017/040776
§ 371 (c)(1),
(2) Date: Jul. 29, 2019

(87) PCT Pub. No.: WO2018/101014
PCT Pub. Date: Jun. 7, 2018

(65) Prior Publication Data

US 2020/0024782 A1 Jan. 23, 2020

(30) Foreign Application Priority Data

Nov. 29, 2016 (JP) ..... JP2016-231277

(51) Int. Cl.
*D05C 7/04* (2006.01)
*B26F 1/24* (2006.01)
*D05B 15/00* (2006.01)

(52) U.S. Cl.
CPC ..... *D05C 7/04* (2013.01); *B26F 1/24* (2013.01); *D05B 15/00* (2013.01)

(58) Field of Classification Search
CPC .... D05C 7/04; D05C 9/04; B26F 1/24; B26D 7/00
See application file for complete search history.

(56) References Cited

U.S. PATENT DOCUMENTS 2,275,612 A * 3/1942 Chandler ..... B26F 1/24 264/156
8,733,263 B2 * 5/2014 Kawaguchi ..... D05C 7/04 112/470.06
2008/0178785 A1 * 7/2008 Resta ..... D05B 35/06 112/113

FOREIGN PATENT DOCUMENTS

CN 209065930 U * 7/2019
CN 209522862 U * 10/2019
(Continued)

OTHER PUBLICATIONS

PCT International Search Report for PCT/JP2017/040776, dated Feb. 13, 2018, 2 pgs.
(Continued)

*Primary Examiner* — Tajash D Patel
(74) *Attorney, Agent, or Firm* — Patterson Thuente Pedersen, P.A.

(57) ABSTRACT

An embroidery sewing machine including: a perforation head having a plurality of vertically reciprocating bars and punches where each punch includes a perforation head; a receiving base having a receiving member configured to receive the punch; a holder frame for supporting a workpiece in an expanded state between the punch and the receiving base, the holder frame being configured to be controlled to move in two-dimensional planar directions; and a tape feed mechanism feeding a tape-like cushioning material having a wider width than at least a processing area of the punch, wherein the material is fed from the front/rear direction and between the workpiece supported in the holder frame and an upper surface of the receiving member, and wherein an upstream portion of the material is shifted downstream to where the receiving member is located according to the vertically reciprocating motion of the punch.

20 Claims, 12 Drawing Sheets

(56) References Cited

FOREIGN PATENT DOCUMENTS

| | | | | | |
|---|---|---|---|---|---|
| JP | 2002 239992 | A | | 8/2002 | |
| JP | 2016 175158 | A | | 10/2016 | |
| WO | WO-2004099448 | A2 | * | 11/2004 | ..... C14B 17/06 |
| WO | WO 2015/076389 | A1 | | 5/2015 | |

OTHER PUBLICATIONS

English translation of PCT International Search Report for PCT/JP2017/040776, dated Feb. 13, 2018, 1 pg.
PCT Written Opinion of the ISA for PCT/JP2017/040776, dated Feb. 13, 2018, 3 pgs.

* cited by examiner

PERFORATING APPARATUS AND EMBROIDERY SEWING MACHINE WITH THE PERFORATING APPARATUS

CROSS-REFERENCE TO RELATED APPLICATIONS

The present application is a National Phase entry of, and claims priority to, PCT Application No. PCT/JP2017/040776, filed Nov. 13, 2017 which claims priority to Japanese Patent Application No. 2016-231277, filed Nov. 29, 2016, both of which are incorporated by reference herein in their entireties for all purposes.

BACKGROUND

The present disclosure relates to a perforating apparatus and an embroidery sewing machine utilizing said perforating apparatus.

Conventional perforating apparatuses, such as that disclosed in WO2015/076389, have been known in the art, where said apparatuses typically have a perforation head for forming perforations in a workpiece such as a leather sheet. The mentioned prior art publication discloses a device including a sewing machine that has a perforation head for performing perforation processes and an embroidery head for doing embroidery around the perforations formed in the perforation processes. When performing the perforation processes by applying the perforation head to a workpiece such as a leather sheet, this device requires several preliminary processes. The processes include a process for placing a resin sheet with a thickness of approximately 0.5 mm as a cushioning material on a receiving base that receives a leading end of a punching blade (perforation tool) of the perforation head, a process for overlaying a leather sheet on the resin sheet as well as setting these in a holder frame, and finally a process for performing the perforation process itself by the punching blade in the leather sheet together with the resin sheet. These carried out processes serve to prevent damage on the punching blade (perforation tool), facilitate a reliable perforation process, and reduce noise during the perforation process.

Here, a punched mark may remain on a portion of the resin sheet subjected to a perforation process, this may cause the deterioration of reliability as a recess formed on the resin sheet due to the punched mark may deepen, and then the sheet may shrink and warp to become wavy due to irregularities caused by the punched mark. Therefore, it is fundamentally desirable to replace the resin sheet with a new resin sheet every time when the leather sheet is replaced. However, in view of the cost of the resin sheet, the resin sheet is reused several times to such an extent that the punching quality is not adversely affected, and it is finally discarded.

BRIEF SUMMARY

However, the resin sheet disclosed in WO2015/076389 is required to be the same size as the leather sheet due to its being overlaid with the leather sheet and integrally held in the holder frame. Due to this configuration, the resin sheet must be discarded with parts where no perforation process is carried out, even if the resin sheet is reused several of times to an extent where the perforation quality is not adversely affected. Therefore, a further improvement is required in terms of cost performance. In addition, according to the above-described device, when subsequent processes such as embroidery are conducted after the perforation process, the leather sheet and the resin sheet must be temporally removed from the holder frame, wherein the leather sheet is reset in the holder frame while the resin sheet is removed. Shifting to the subsequent embroidery process in this manner is complicated. Further, it may also be possible that such subsequent embroidery processes are conducted where the resin sheet has not been removed due to user error, causing further problems, etc.

Thus, a perforating apparatus has been desired wherein a subsequent process to perforation, such as embroidery, can be smoothly shifted to while at the same time cushioning material waste can be reduced, and perforation quality can be maintained in a consistent manner.

According to one aspect of the present disclosure, a perforating apparatus comprises: a perforation head including a vertically reciprocating bar and a perforation tool provided at a leading end of the bar; a receiving base arranged below the perforation head and including a receiving member configured to receive the perforation tool which is lowered in accordance with lowering movement of the bar; a holder frame configured to support a workpiece in an expanded state between the perforation tool and the receiving base in a plane direction intersecting the vertical direction of the bar, the holder frame being configured to be controlled to move in directions in two dimensions, such as a front/rear direction of the plane direction and a right/left direction orthogonal to the front/rear direction; and a cushioning material feed mechanism that serves to feed a tape-like cushioning material having a wider width than a processing area of the perforation tool, where the processing area is from the front/rear direction and between the workpiece supported in the holder frame and an upper surface of the receiving member, while shifting a position of the cushioning member according to the vertically reciprocating motion of the perforation tool.

One feature and advantage of the present disclosure is that the waste of the cushioning material to be fed may be reduced because the cushioning material feed mechanism feeds the tape-like cushioning material wherein said material has a wider width than at least a processing area of the perforation tool, while at the same time the feed mechanism can shift the position of the cushioning material from upstream to downstream in response to the vertically reciprocating motion of the perforation tool. Further, since the cushioning material with punched marks remained is successively feed downstream from the perforation location, the deterioration of the reliability caused by the irregularities formed by the punched marks on a same or proximate location of the material may be prevented during the perforation process. That is, the perforation quality can be maintained in a consistent manner. Further, the workpiece after the perforation process may be easily shifted to a subsequent process since the cushioning material feed mechanism is compartmentalized, and structurally configured to feed the cushioning material independently from the workpiece being supported and movable in the holder frame. Furthermore, even when replacement of the cushioning material is needed during the perforation process, the replacement of the cushioning material is possible without removing the workpiece from the holder frame and the replacement workability may be improved. Since the cushioning material feed mechanism is configured to feed the cushioning material from the front/rear direction, the machine is prevented from increasing in size in the right/left direction. This is remarkable for the perforating apparatus comprising a plurality of the perforation heads. Therefore, the perforating apparatus can smoothly shift to the subsequent process while reducing the waste of the cushioning material and maintaining the perforation quality constant.

The cushioning material feed mechanism of the above perforating apparatus may include a reel with a cushioning material wound, and the reel is preferably supported to a frame designed to support the receiving base below the perforation head along the front/rear direction.

Another feature and advantage of the present disclosure is that it is possible to further prevent the machine from increasing in size in the right/left direction.

The cushioning material feed mechanism of the above perforating apparatus, preferably includes a feed portion configured to feed the cushioning material between the workpiece supported in the holder frame and the upper surface of the receiving member. A detection mechanism is provided within the feed passage of the cushioning material from the reel to the feed portion, wherein the detection mechanism is configured to detect the feed condition of the cushioning material by an actuator that is capable of being displaced under its own weight in accordance with tension applied to the cushioning material.

Another feature and advantage of the present disclosure is that it is possible to determine whether the cushioning material is stably fed or not, since the detection mechanism is provided within the feed passage between the reel to the feed portion wherein the detection mechanism is configured to detect the feed condition of the cushioning material where the actuator is capable of being displaced in accordance with tension applied to the cushioning material.

The feed portion of the perforating apparatus may preferably be built within the receiving base.

Another feature and advantage of the present disclosure is that the cushioning material feed mechanism may be formed in a compact construction since the feed portion is built in the receiving base.

The detection mechanism of the above perforating apparatus may preferably include: an inverting member configured to guide the cushioning material; a movable body configured to axially support the inverting member in a rotatable manner, the movable body being configured to slidably move together with the inverting member in response to level of the tension applied to the inverting member from the cushioning material; a displacement member supported to the movable body; and a sensor configured to detect slide motion of the inverting member.

Another feature and advantage of the present disclosure is that the detection mechanism may include a movable body configured to axially support the inverting member in a rotatable manner, the movable body being configured to slidably move together with the inverting member in response to level of the tension applied to the inverting member from the cushioning material, and a displacement member supported to the movable body. Further, the detection mechanism may include a sensor configured to detect slide motion of the displacement member. Therefore, it is possible to determine whether the cushioning material is stably fed or not by detecting whether the inverting member for guiding the cushioning material is positioned in an appropriate position or not when the cushioning material is fed from the reel to the feed portion through movement of the movable body.

The displacement member of the above perforating apparatus may preferably move upward as the inverting member is lifted when the tension is applied to the cushioning material due to abnormal rotation of the reel, and move downward due to weight of the movable body as the cushioning material wound around the reel is completely fed or loosened while the tension is not applied to the cushioning material.

Another feature and advantage of the present disclosure is that the displacement member may detect delay or stop of feeding of the cushioning material due to the abnormal rotation of the reel, or completion of the feed of the cushioning material wound around the reel or loosening of the cushioning material by upward or downward motion of the movable body supporting the inverting member.

The receiving base of the above perforating apparatus may preferably include a receiving plate with a window hole into which the perforation tool can be inserted, and a guide provided on the underside of the receiving plate, the guide being configured in a convex curved manner to restrict the cushioning material from moving relative to the window hole in the width direction and to restrict the cushioning material from being removed out of the window hole.

Another feature and advantage of the present disclosure is that the cushioning material may be stably fed because the guide may restrict the cushioning material from moving with respect to the window hole in the width direction and restrict the cushioning material from exiting upwards out from the window hole.

The guide of the above perforating apparatus is preferably configured to guide the cushioning material to the feed portion by a convex curved surface directing to the perforation tool.

Another feature and advantage of the present disclosure is that the guide may smoothly feed the cushioning material to the feed portion since it is configured to guide the cushioning material to the feed portion by the convex curved surface directing to the perforation tool.

The cushioning material feed mechanism of the above perforating apparatus is preferably configured to be able to adjust the feed pitch of the cushioning material as desired.

Another feature and advantage of the present disclosure is that the waste of the cushioning material to be fed can be further reduced, since the cushioning material feed mechanism is configured to be able to switch the feed pitch of the cushioning material. Further, the work efficiency of the perforation process may be improved because the feed amount can be switched in accordance with the configuration or an area of the perforation tool.

The perforation head of the perforating apparatus may include a plurality of the perforation tools with various planar shapes. The cushioning material feed mechanism is preferably configured to be able to switch the feed amount of the cushioning material in response to switching of the various perforation tools.

Another feature and advantage of the present disclosure is that both the flexibility of the perforation forming and the work efficiency of the perforation process can be improved, since the feed amount of the cushioning material can be automatically switched in response to kind of the various perforation tools.

The embroidery sewing machine may have the above perforating apparatus and an embroidery head including a vertically reciprocating needle bar and a sewing needle provided at a leading end of the needle bar.

Another feature and advantage of the present disclosure is that the perforation process and embroidery process can be smoothly carried out by the sewing machine. In particular, if the sewing machine is an embroidery sewing machine having the perforating apparatus, the embroidery head including the vertically reciprocating needle bar and the sewing needle provided at the leading end of the needle bar helps to smoothly carry out such a process after perforation.

DETAILED DESCRIPTION

First Embodiment

Hereinafter, the first embodiment for carrying out the present disclosure will be described with reference to FIGS. 1 to 11. The first embodiment of the present disclosure will be described by illustrating an embroidery sewing machine main body 1 that includes a perforation head 4 for perforating and an embroidery head 3 for embroidering. The embroidery sewing machine main body 1 with the perforation head 4 and the embroidery head 3 will be described as an example of the first embodiment. However, the first embodiment is not limited to the embroidery sewing machine main body 1 and if appropriate, a perforating apparatus that includes only the perforation head 4 may also be adopted.

Outline of the Machine

Figure 1:
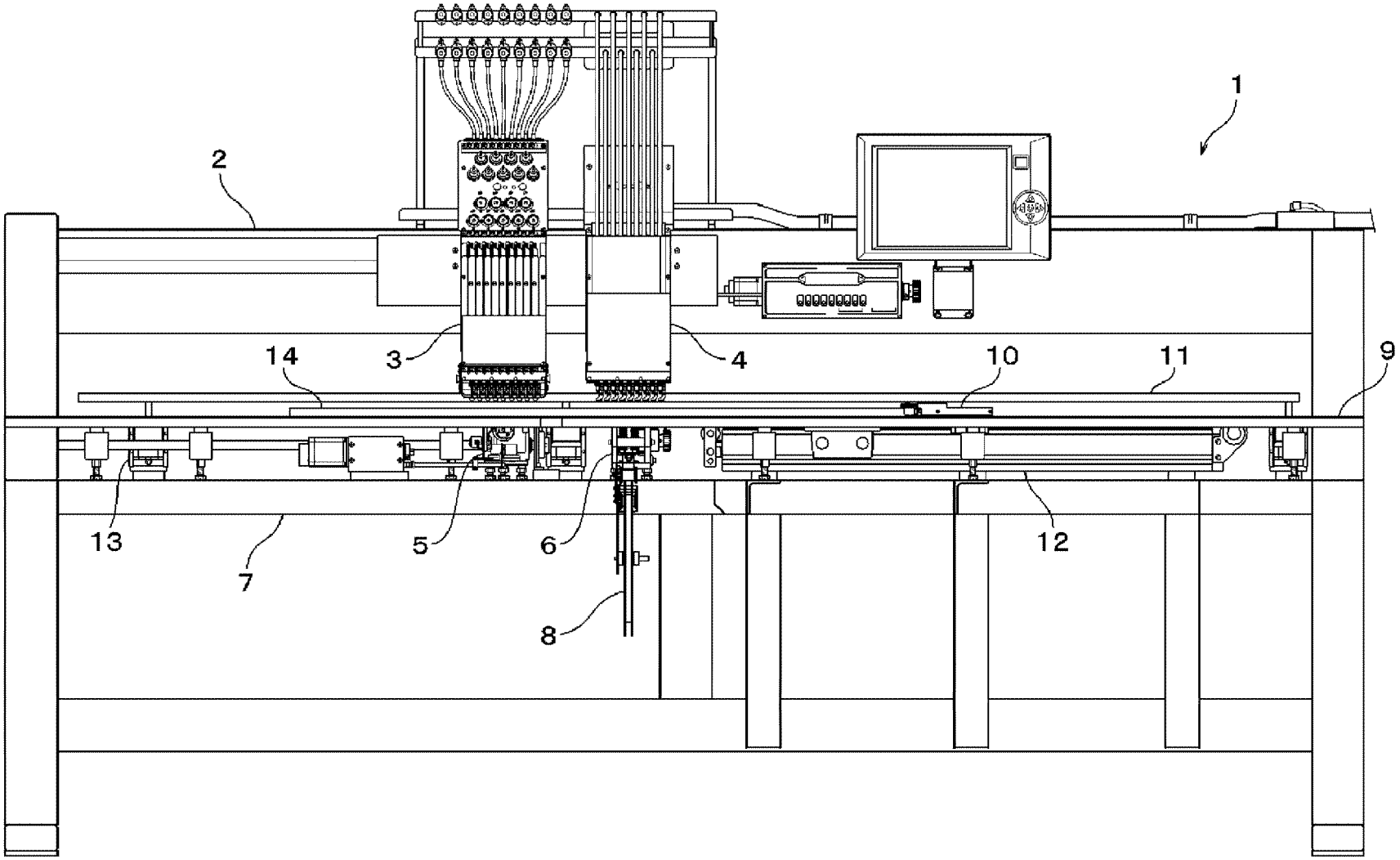
FIG. 1 is a front view of a sewing machine according to a first embodiment.

As shown in FIG. 1, a well-known embroidery head 3 and a perforation head 4 are arranged side by side at a spaced interval in front of an upper frame 2 of the embroidery sewing machine main body 1. The embroidery head 3 includes a plurality of needles. A hook base 5 is disposed below the embroidery head 3 on a lower frame 7, wherein the hook base 5 has a well-known rotary hook which performs a sewing operation in cooperation with the needles of the embroidery head. Further, a receiving base 6 is arranged below the perforation head 4 together with a tape feed mechanism 8 (cushioning material feed mechanism), wherein the receiving base 6 supports a punch base 30 (see FIG. 9).

An X-direction drive 10 and a Y-direction drive 11 are disposed on a sewing machine table 9. The X-direction drive 10 is connected to an X-drive portion 12 that is fixed to the lower frame 7 below the sewing machine table 9. The Y-direction drive 11 is connected to a Y-drive portion 13 that is similarly fixed to the lower frame 7. The holder frame 14 supporting the workpiece is removably connected to the X-direction drive 10 and the Y-direction drive 11, such that the holder frame 14 is shifted in the X-Y direction according to the shifting of the X-direction drive 10 and the Y-direction drive 11 in each respective X or Y direction based on pattern data from a controller as described infra. The Y-direction is referred to as a front/rear direction on a plane of the sewing machine table 9 (the upper surface of 9 as seen from a top view, where the front/rear direction would extend into and out of the page as seen in FIG. 1). The X-direction is referred to as a right/left direction orthogonal to the front/rear direction on said plane of the sewing machine table 9 (the upper surface of 9 as seen from a top view, where the right/left direction would extend in the right and left directions relative to the page showing FIG. 1). In this way, the holder frame 14 supports the workpiece between the punches (perforation tools) 17 of a perforation head 4 that is described infra, and the receiving base 6. Additionally, the workpiece is in an expanded state in the planar direction parallel to that of table 9 which intersects an up/down direction of vertically reciprocating needle bars 15. The holder frame 14 is configured to be controlled to move in directions in two dimensions including a front/rear direction (Y-direction) and a right/left direction (X-direction) intersecting the front/rear direction.

Although not shown, the embroidery sewing machine main body 1 according to the first embodiment includes a controller (control means) having a microprocessor operating in accordance with a software program or a dedicated circuit etc. Here, the controller may include a memory means that serves to store specific instructions in a memory medium, forming a memory structure, for example, perforation pattern data enabling the device user to perform the perforation process on a leather sheet (workpiece) or embroidery pattern data enabling the device user to perform embroidery on the workpiece, around perforation holes which may have been previously formed by the perforation process. Various such operations described in the first embodiment may be memorized as commands for software programs and the commands may be stored in a non-transitory and non-volatile computer readable memory medium. Therefore, the embroidery sewing machine main body 1 is able to carry out various operations such as a perforation process operation and an embroidery operation, which will be described infra, based on the perforation pattern data or the embroidery pattern data in accordance with the control paradigm used by the controller.

Perforation Head 4

Figure 2:
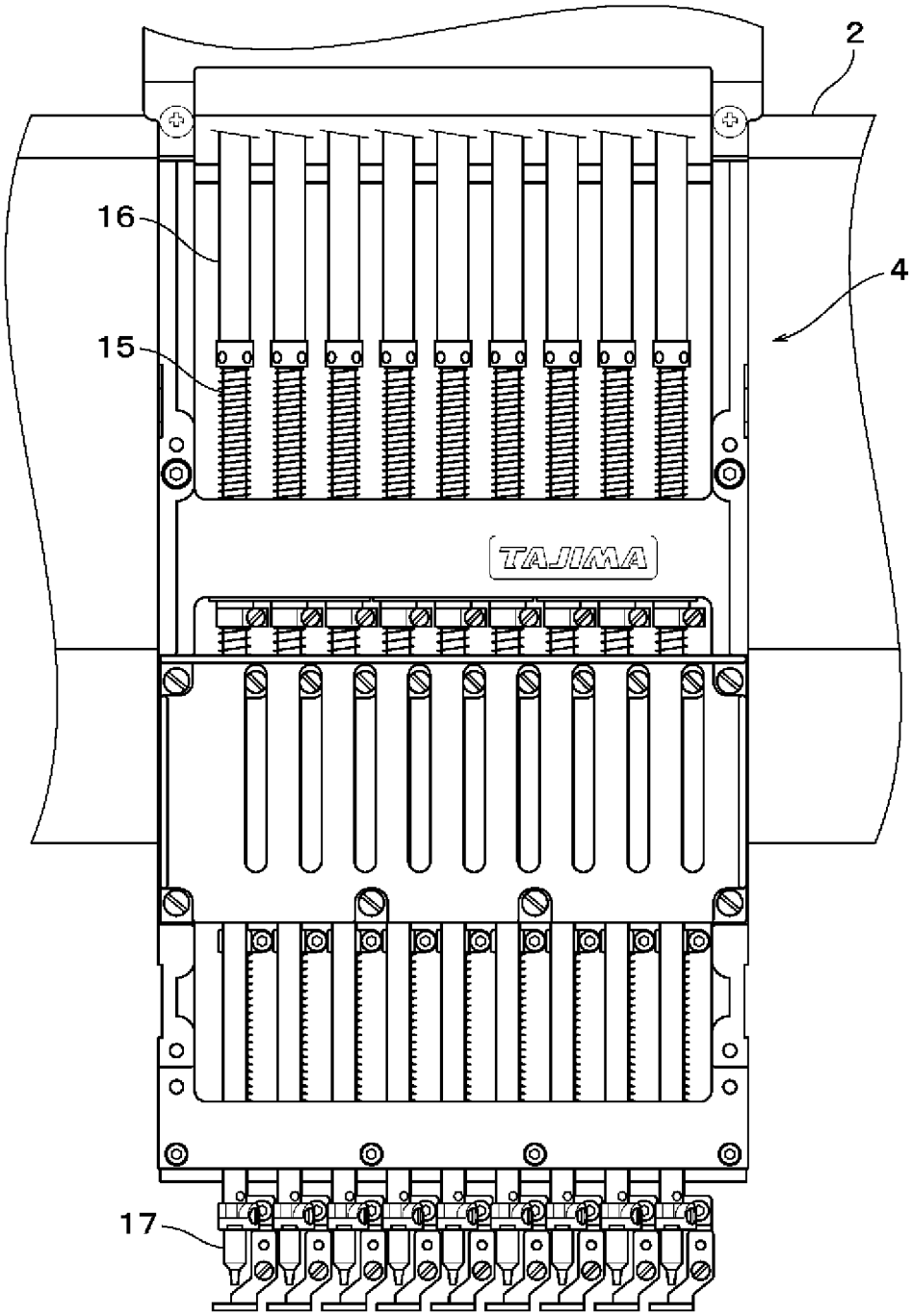
FIG. 2 is a front view of a perforation head according to the first embodiment.

As shown in FIG. 2, the perforation head 4 is configured to exclude a take-up lever and a thread guide from a needle bar case of the well-known embroidery head 3 (see FIG. 1), and is provided with a plurality of vertically reciprocating needle bars 15 similar to the embroidery head 3, which will be described infra. Each needle bar 15 is hollow, and has an upper and lower end. A tube 16 connected to a vacuum device (not shown) is attached to the upper end of each needle bar 15. Further, a punch (perforation tool) 17 is attached to the lower end of each needle bar 15. Since no needle is actually attached to the needle bar 15 of the perforation head 4, the needle bar 15 is hereinafter referred to as a vertically reciprocating bar.

Figure 3:
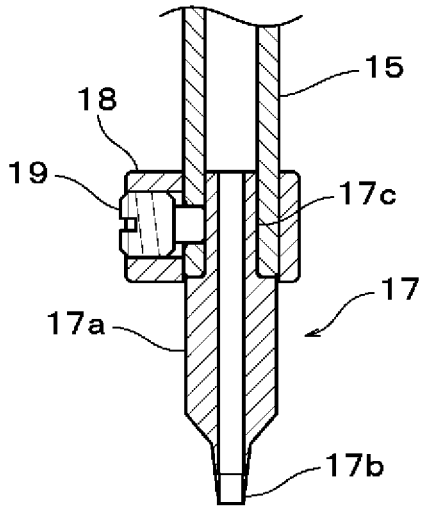
FIG. 3 is a cross-sectional side view illustrating a mounted state of a punch (perforation tool) to a needle bar (vertically reciprocating bar) according to the first embodiment.
Figure 4:
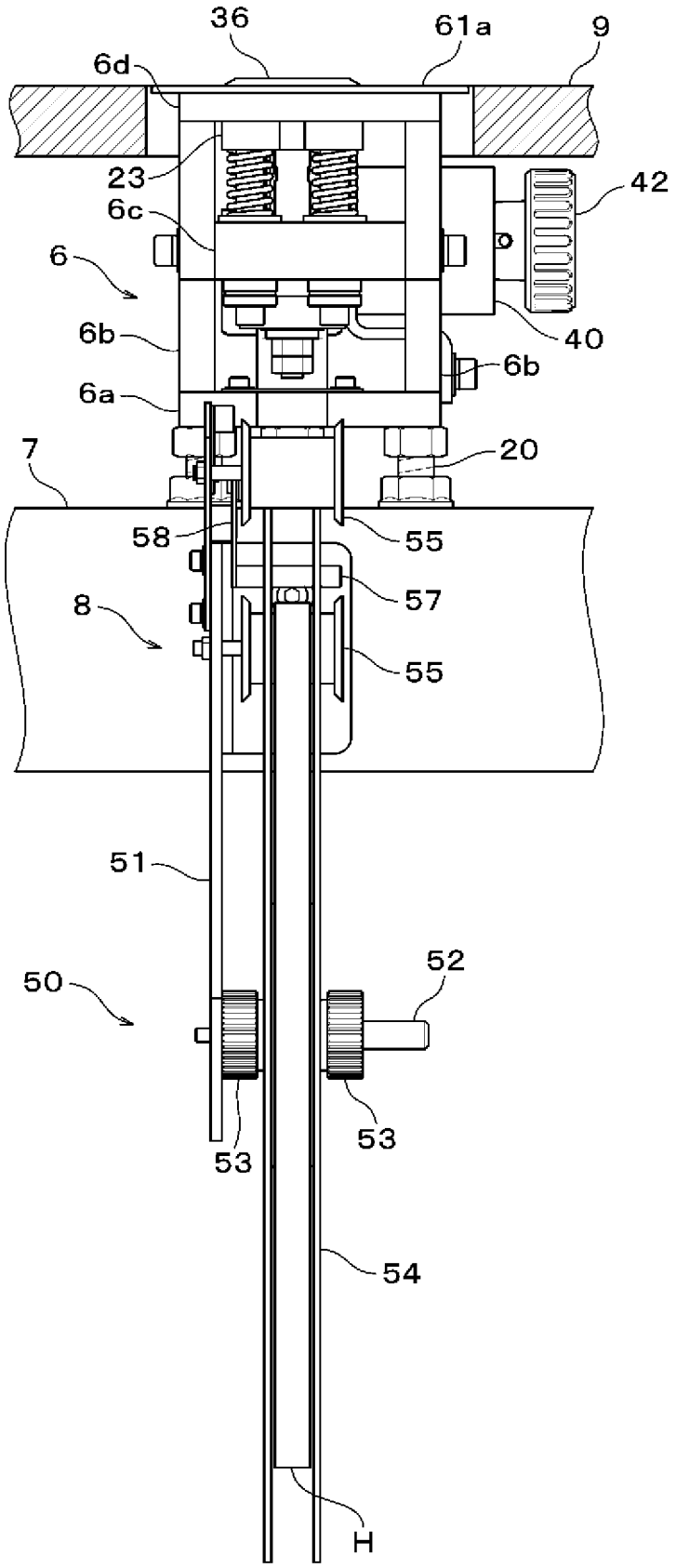
FIG. 4 is a front view of a receiving base and a tape feed mechanism (cushioning material feed mechanism) according to the first embodiment.

As shown in FIG. 3, the punch 17 includes a perforation blade 17*b* (circular blade in a flat circular shape in the present example) formed at the lower end of a main body 17*a*, and an attachment portion 17*c* formed at the upper end of the main body 17*a*. The attachment portion 17*c* of the punch 17 is fitted into the lower end of the vertically reciprocating bar 15 and a screw 19 of the needle holder 18 is tightened to fasten the vertically reciprocating bar 15 to the punch 17. In this way, the punch 17 may be fixed to the vertically reciprocating bar 15. In the present example, similar punches 17 are attached to the plurality of bars 15 as shown in FIG. 2. However, alternately, various punches 17 having a perforation blade 17*b* with a different planar shape may be used, such as, for example, a triangular shape, square shape, pentagonal shape, ellipse shape, star shape or the same circular shape with a different diameter size.

Receiving Base 6

The receiving base 6 is, as shown in FIGS. 4 to 8, configured as a base comprising a bottom plate 6*a*, lateral plates 6*b* fixed upright on the right and left sides of the base's upper surface extending in the front/rear direction, a support plate 6*c* laid between the front lower portion of the lateral plates 6*b*, and an upper plate 6*d*. The bottom plate 6*a* is fixed on a lower frame 7 with bolts 20. A cover plate 61*a* and a cover plate 61*b* are fixed to the upper plate 6*d*.

Figure 8:
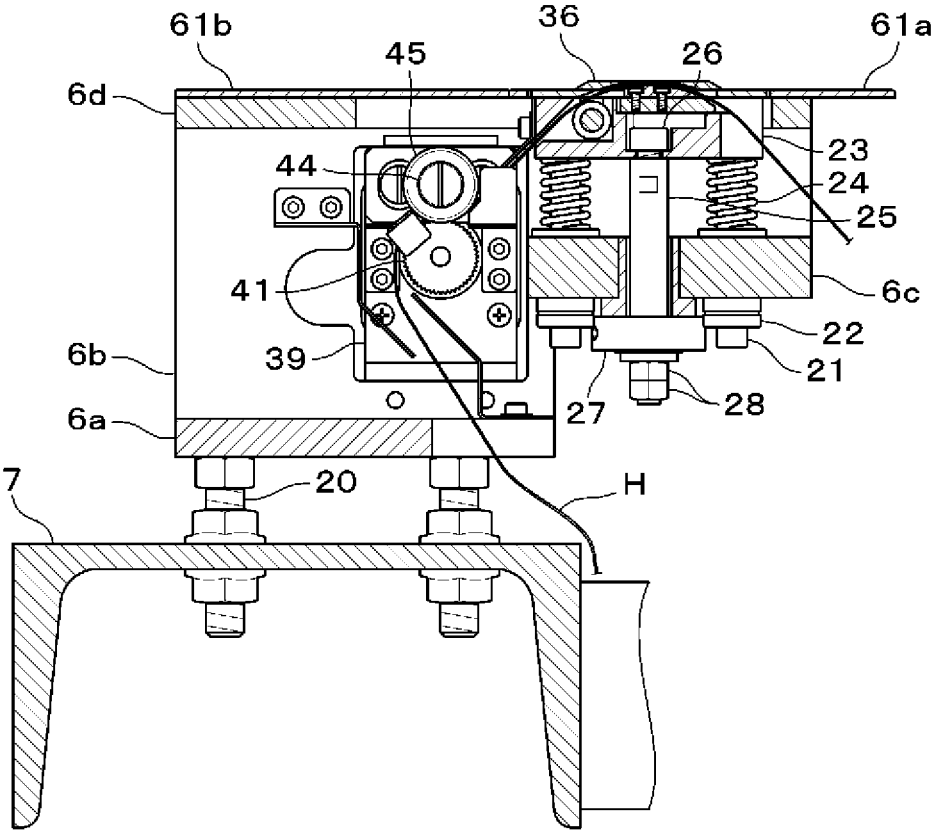
FIG. 8 is a cross-sectional side view of the receiving base and a feed portion of the tape feed mechanism (cushioning material feed mechanism) according to the first embodiment.

As shown in FIG. 8, four sleeves 22 each with a guide rod 21 that is inserted through each respective sleeve 22, are driven into the support plate 6*c* for a predetermined length. Each guide rod 21 is guided into the sleeve 22 so as to be vertically slidable, and a holding member 23, for holding the guide rods in place, is fixed to the upper end of the guide rod 21. A compression coil spring 24 is fitted to each guide rod 21 between the support plate 6*c* and the holding member 23 to bias the holding member 23 upwardly via its spring biasing force. Further, an adjustment rod 25 with an upper and lower end is inserted at a central position of the support plate 6*c*, where said central position is at the center of support plate 6*c* relative to the four guide rods 21. The upper end of the adjustment rod 25 is fixed on the lower surface of the holding member 23 by a screw 26, while the lower end projects downward from the bottom of support plate 6*c*. A stopper 27 (split collar) is fitted to the portion projecting downwards from the bottom of support plate 6*c*, and a nut 28 is added and screwed on to the leading end portion at the bottom of the adjustment rod 25. A position of the upwardly biased holding member 23 can be adjusted by tightening this nut 28.

Figure 9:
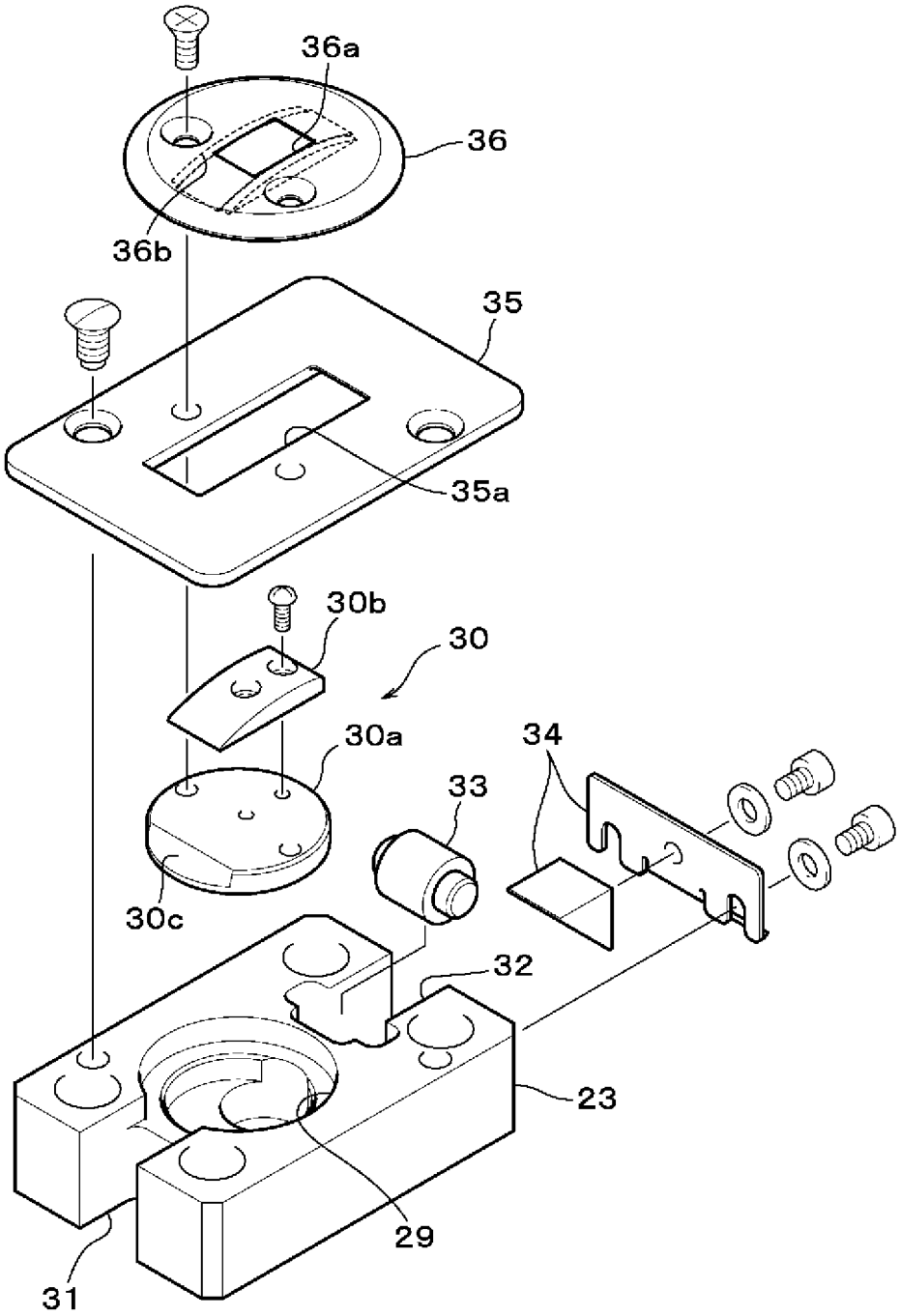
FIG. 9 is an exploded perspective view of a punch base according to the first embodiment.

As shown in FIG. 9, a circular recessed holding portion 29 is formed on the upper surface of the holding member 23, and a brass punch base 30 is fitted into this holding portion 29. A notch is formed at the front center of the holding member 23, extending from the front portion of the outer circumferential boundary of circular recessed holding portion 29 to the center of the front side of the holding member 23 as shown in FIG. 9, serving as a feed inlet 31 for the tape-like cushioning material H (see FIG. 8). A recess, facing laterally opposite to the notch is formed extending from the vicinity of but spaced apart from the rear portion of the outer circumferential boundary of circular recessed holding portion 29, toward the rear center of the holding member 23, serving as an outlet 32 of the tape-like cushioning material H, and a roller 33 is rotatably fitted into said recess. The outlet 32 is provided with a guide 34 configured to guide tape-like cushioning material H to the feed portion 37 as will be described infra (see FIG. 11).

The punch base 30 comprises a base member 30*a* and a receiving material 30*b*. The base member 30*a* is formed as a circular plane having a downward inclined surface 30*c* oriented in the same direction facing toward the front center of the holding member 23 as the feed inlet 31 of the holding member 23. The upper surface of the receiving member 30*b* is formed as a guide surface in a curved arc shape, and is screwed onto the base member 30*a* such that it lies flat on and flush against 30, with the thickness side of receiving member 30*b* extending along the base member's inclined surface side 30*c*.

Figure 10:
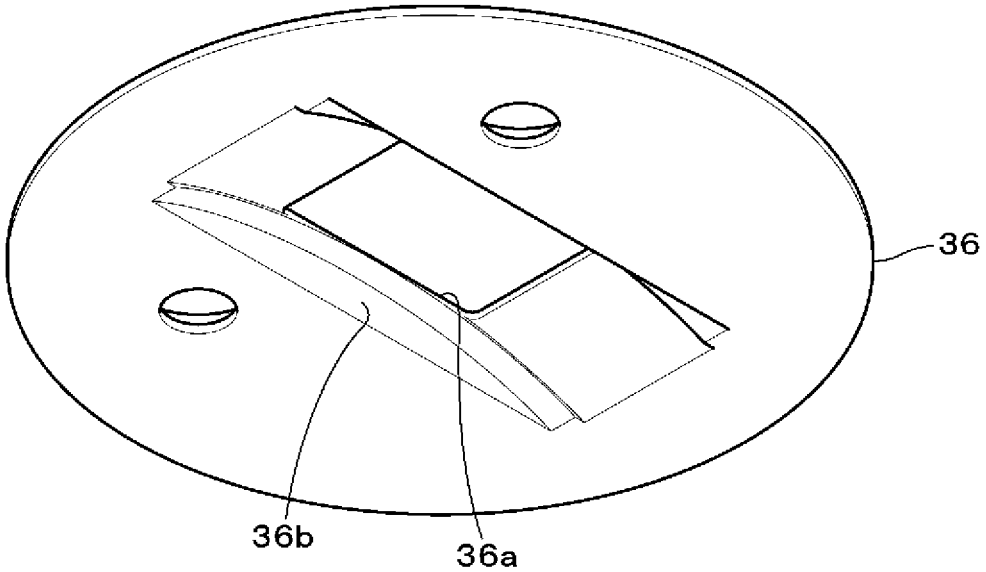
FIG. 10 is a perspective view of a receiving plate according to the first embodiment.

A cover plate 35 is screwed onto the upper surface of the holding member 23. An window hole 35*a* is formed centrally within the cover plate 35 as a feed passage for the tape-like cushioning material H (see FIG. 8). As seen in the exploded view of FIG. 9, once the cover plate 35 is assembled to holding member 23, the receiving member 30*b* is positioned in the middle of the window hole 35*a*. A circular receiving plate 36 is screwed onto the cover plate 35 so as to cover the window hole 35*a*. The receiving plate 36 includes a window hole 36*a* through which the punch 17 is inserted. A guide portion 36*b* is formed on the underside of receiving plate 36 in a position corresponding to the location of window hole 35*a* of the base plate 35 when 36 is overlaid on 35 as shown in FIG. 9. FIG. 10 shows the underside of the receiving plate 36. The guide portion 36*b* is notched to form a circular arc toward the directions of the feed inlet 31 and outlet 32, wherein the width of the arc (in the left to right direction) is wider than the window hole 36*a* through which the punch 17 is inserted, and slightly wider (11 mm) than the width (10 mm) of the tape-like cushioning material H. As a result of the guide portion 36*b* being wider in this manner, the tape-like cushioning material H passes between the receiving member 30*b* of the punch base 30 and the receiving plate 36 and is guided along the guide portion 36*b* without leaving the base plate 36 region upwards from the window hole 36*a* of the receiving plate 36.

The aforementioned receiving base 6 includes a tape-like feed mechanism 8 (cushioning material feed mechanism) comprising a feed portion 37 and a reel support portion 50.

Feed Portion 37

Figure 11:
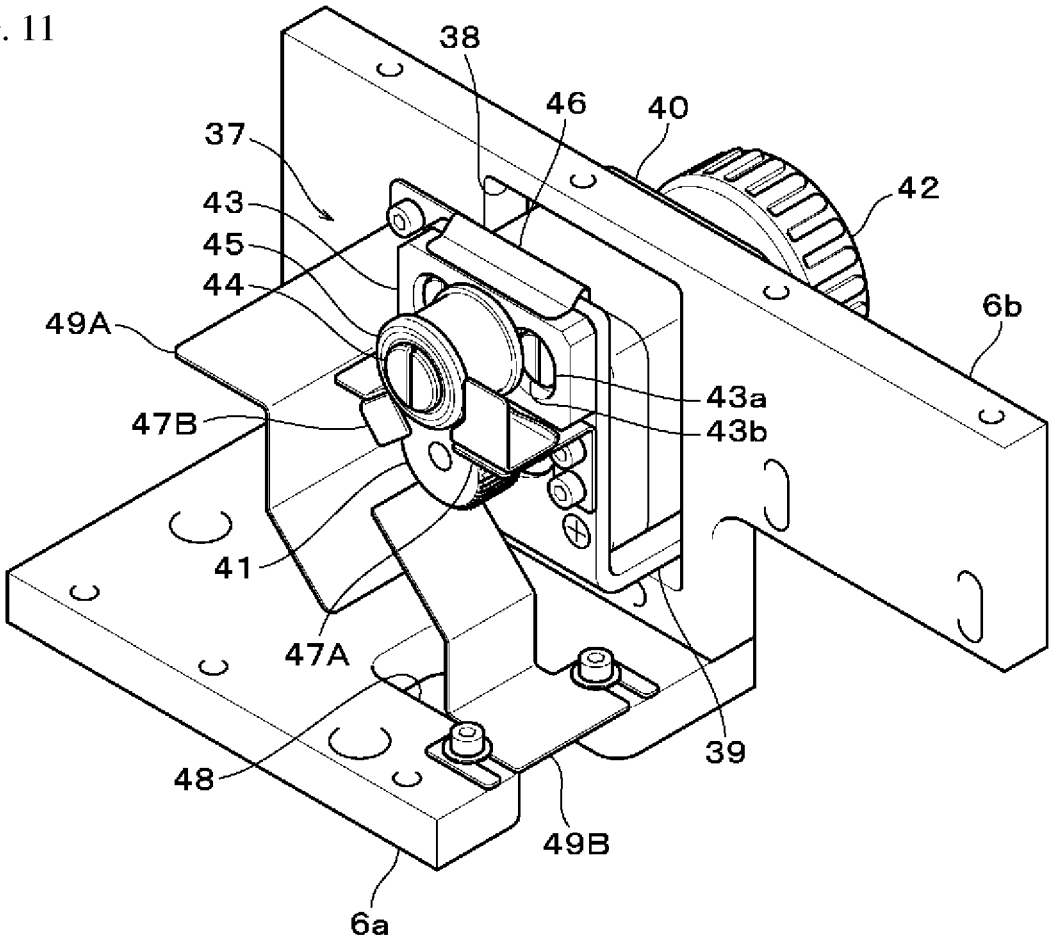
FIG. 11 is a perspective view of a feeding portion of the tape feed mechanism (cushioning material feed mechanism) according to the first embodiment.

FIG. 11 shows the feed portion 37 in detail. The feed portion 37 is built in the receiving base 6 (see FIGS. 4 and 5) and is arranged behind the punch base 30 (see FIG. 9). A notch 38 is provided on the right lateral plate 6*b* of the receiving base 6. A motor 40 is fixed to an erected bracket 39 which extends from the outer side of the notch, through the notch 38, and to the inner side in the left-to-right direction. A drive roller 41 forms an inward extension of and is attached to an inner side end of the motor shaft while a handle 42 for manually operating the motor shaft is attached to the laterally opposite outer side end of the motor shaft. A driven roller 45 rotatably abuts the upper portion of the drive roller 41. The driven roller 45 is supported by a support pin 44 of a damper 43 such that it is rotatable about said support pin 44. The damper 43 includes adjacent elongated holes 43*a* to the right and left of its support pin 44, as seen in FIG. 11. The damper 43 is vertically slidably supported on the bracket 39 whereby its position is manipulable by the pins 43*b* inserted through the elongated holes 43*a*. The damper 43 is downwardly biased by a spring plate 46 that is clasped to the bracket on the upper portion of the bracket 39. Thereby, with this structural configuration, since due to the presence of the spring plate 46 the driven roller 45 is consequently always downwardly biased toward a roller surface of the drive roller 41, where the tape-like cushioning material H is held between the drive roller 41 and the driven roller 45, and said tape-like cushioning material H is transported by the rotation of the drive roller 41. Guides 47A and 47B are arranged in front of and behind the position where the drive roller 41 and the driven roller 45 hold the tape-like cushioning material H. The guides 47A and 47B serve to hold the tape-like cushioning material H and restrict the displacement of the tape-like cushioning material H (see FIG. 8). Guides 49A and 49B are arranged behind and below the feed portion 37, respectively, and serve to guide the tape-like cushioning material H toward the outlet 48 formed in the bottom plate 6*a* of the receiving base 6.

Reel Support Portion 50

The reel support portion 50 is arranged along the front/rear direction (Y-direction). More specifically, the reel support portion 50 comprises a support base 51, a support shaft 52 and a restricting member 53 (split collar), wherein the reel support portion 50 is arranged diagonally below in front of the receiving base 60. The support base 51 has a substantially L-shaped configuration, and the rear end of the support base 51 is fixed on a front end surface of the lower frame 7 by bolts, while the other end (leading front end part of support base 51) protrudes forward and downward. The support shaft 52 is provided below the leading front end of the support base 51. The support shaft 52 is configured to rotatably support the reel 54 around which the tape-like cushioning material H is wound. The reel 54 is installed on the support shaft 52 and maintained in a substantially upright posture by a restricting member 53 that is positioned on both the outer right and left sides of the reel 54 (see FIG. 4). The restricting member 53 may be displaced in the axial direction to adjust for different widths of the reel 54 depending on the desired size of the tape-like cushioning material H.

A detecting device 56 is used for detecting the completion of feeding of the tape-like cushioning material H that is wound around a plurality of rollers 55 for guiding the tape-like cushioning material H and the reel 54, and is also used as well for detecting the abnormal rotation of the reel 54. The detecting device 56 includes a lever 58 (actuator) that has a lower part including an abutting portion 57, which can abut the tape-like cushioning material H, and a bifurcated upper part, formed at approximately a right angle to the abutting portion, wherein the lever 58 is rotatably provided on the shaft 59. The detecting device 56 is configured to detect the rotation of the lever 58. When the abutting portion 57 of the lever 58 abuts the tape-like cushioning material H, the tape-like cushioning material H supports gravitationally-induced rotation of the abutting portion 57 of lever 58 caused by the weight of the lever 58. When the tape-like cushioning material H is completely used so that the user may be running out of the tape-like cushioning material H, the lever 58 rotates in the counterclockwise direction. The running out of the tape-like cushioning material H may be detected by this counterclockwise rotation. If the reel 54 has failed to rotate for some reason, the tape-like cushioning material H is still tensioned, thereby causing the abutting portion 57 to be lifted and inducing the lever 58 to rotate in the counterclockwise direction. Again, in this manner, the detecting device 56 may detect the abnormality in rotation of the reel 54 by detecting the counterclockwise rotation of the lever 58. As described above, the tape feed mechanism 8 (cushioning material feed mechanism) is configured to feed the tape-like cushioning material H in the front/rear direction (Y-direction).

Tape-Like Cushioning Material H (Cushioning Material)

The tape-like cushioning material H is a cushioning material made of tape-like resin or the like with a width of about 10 mm and a thickness of about 0.5 mm. It should be noted that the size and thickness of the tape-like cushioning material H are not limited as described-above and can be appropriately applied in accordance with the size of the punch 17.

Method for Setting Cushioning Material H

Figure 5:
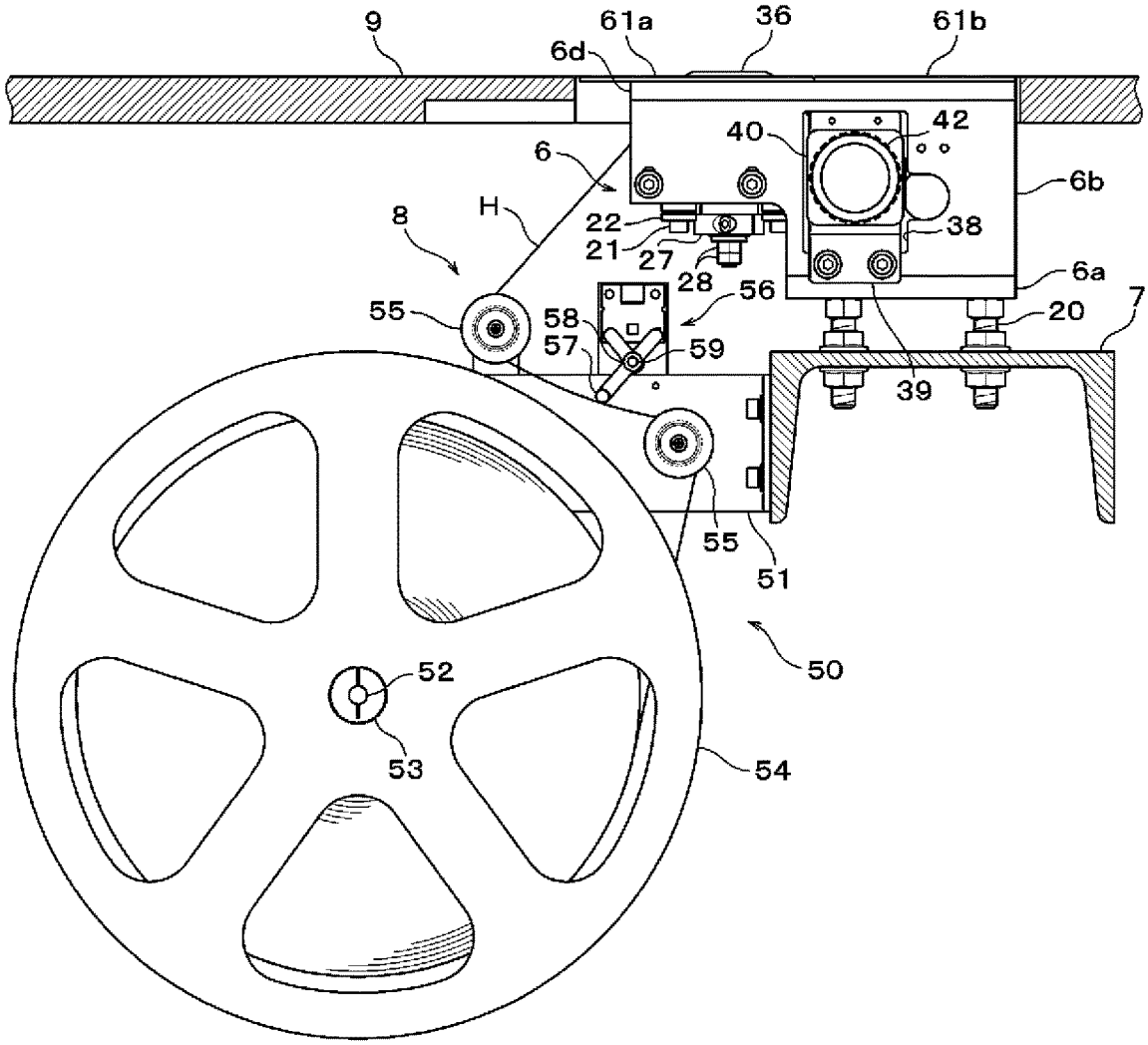
FIG. 5 is a side view of the receiving base and the tape feed mechanism (cushioning material feed mechanism) according to the first embodiment.
Figure 6:
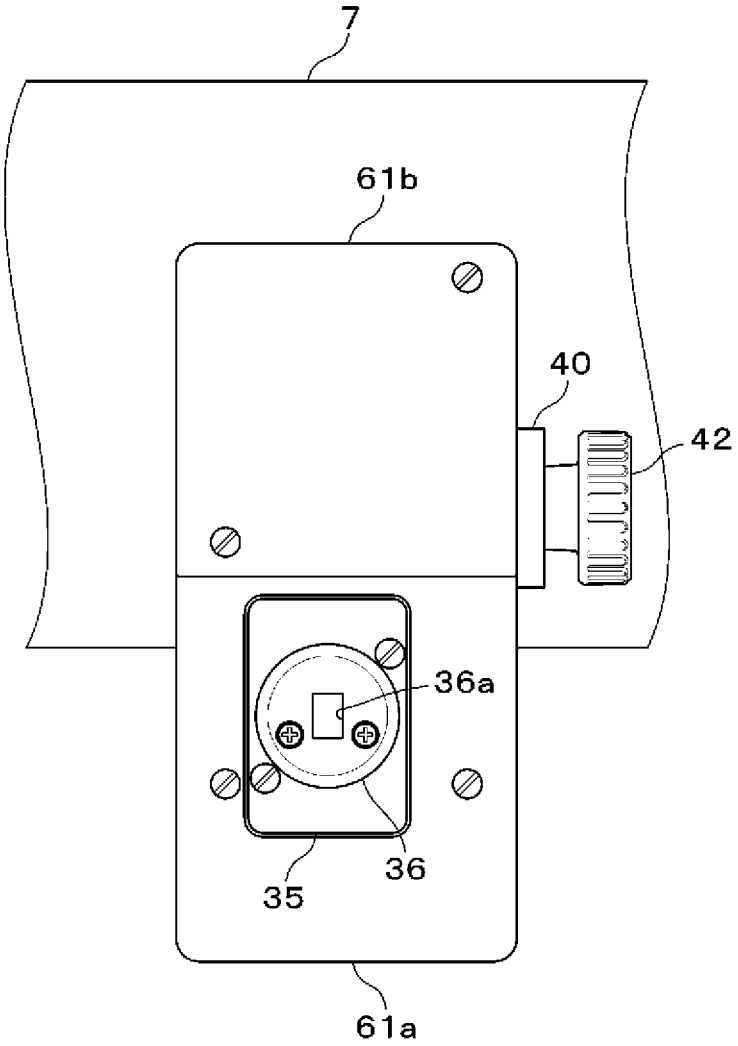
FIG. 6 is a top view of the receiving base according to the first embodiment.
Figure 7:
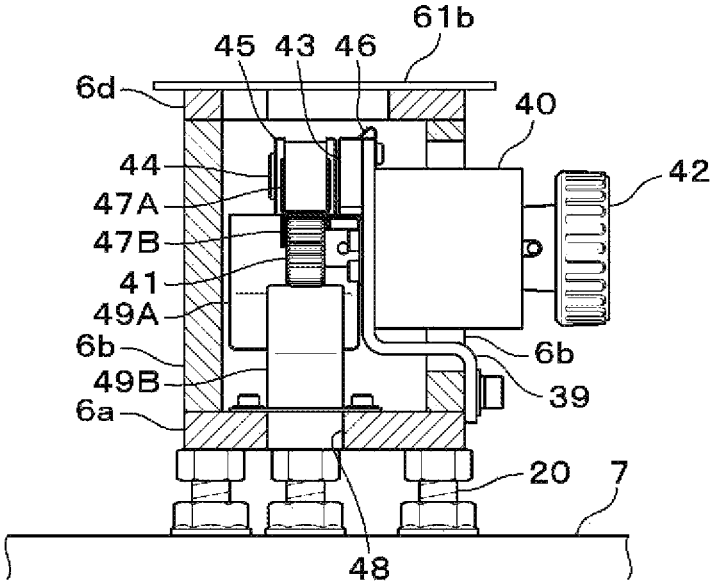
FIG. 7 is a sectional front view of the receiving base according to the first embodiment.

Hereinafter, the method for setting the tape-like cushioning material H will be described. First, the tape-like cushioning material H which is wound around the reel 54 may be attached to the reel support portion 50. The tape-like cushioning material H may be guided to the front of the receiving base 6 by being attached to each of the rollers 55, as seen in FIG. 5.

Subsequently, after being attached to the rollers 55 in the described manner, the tape-like cushioning material H may be inserted from the feed inlet 31 of the holding member 23 toward the punch base 30. The tape-like cushioning material H may be guided toward the outlet 32 of the holding member 23 along the arc of the upper surface of the receiving member 30*b* of the punch base 30 and along the guide portion 36*b* on the underside of the receiving plate 36.

Further subsequently, the handle 42 for manual operation of the motor shaft may be rotated by the user, serving to feed the tape-like cushioning material further downstream when the tape-like cushioning material H reaches the feed portion 37.

Feed Operation of the Tape-Like Cushioning Material H

Hereinafter, the feed operation of the tape-like cushioning material H on a leather workpiece (applicable to other workpieces also) will be described. After setting the tape-like cushioning material H as described, a perforation process is carried out on the leather sheet by the perforation head 4 in accordance with the perforation pattern data (or embroidery pattern data) stored in the microprocessor of the sewing machine main body, while the holder frame 14 that is holding the leather sheet workpiece is controlled to shift in the X-Y direction on the upper surface of the sewing machine table 9. Here, during carrying out the perforation process by the perforation head 4, the by the X-direction drive 10 and/or Y-direction drive 11, respectively. The tape feed mechanism 8 may operate as will be described below.

In accordance with the aforementioned stored perforation pattern data, the leather sheet may be shifted into a position where the perforation should be carried out. Punches 17 may be selectively chosen, and the selected punches 17 of the perforation head 4 may subsequently be lowered and inserted into the leather sheet (wherein insertion describes when a perforation blade 17*b* of the punch 17 as shown in FIG. 3 pierces the tape-like cushioning material H so that a punched mark is formed). The punches 17 may then be lifted and removed from the leather sheet so as to finish forming perforations in the leather sheet. After the punches 17 are removed from the leather sheet, the leather sheet may be transferred to a subsequent perforation position. Before the punches 17 pierce the leather sheet again, the motor 40 for the feed portion 37 may be actuated so that the drive roller 41 rotates at an angle corresponding to a predetermined feed pitch in a counterclockwise direction. As a result, the tape-like cushioning material H may be fed in a transport direction and a portion of the tape-like cushioning material H on the receiving member 30*b* of the punch base 30 may be moved further downstream so that a previously upstream portion of unwound cushioning material H may be moved downstream to the receiving member 30*b*. This motion is repeated so that the tape-like cushioning material H may be fed at a predetermined pitch to each perforation process, wherein a portion of the tape-like cushioning material H on the receiving member 30*b* of the punch base 30 may be replaced by a previously upstream portion of the cushioning material H, due to movement of the motor. A collection box or shredder device may be provided below the lower frame 7 for collecting the used tape-like material H that is fed.

Feed Pitch of the Tape-Like Cushioning Material H

The feed pitch of the tape-like cushioning material H may be set as desired on an operation display. Such a feed pitch setting allows, for example, a surface of the tape-like cushioning material H placed on the receiving member 30*b* (that is the surface where the punch comes into contact) to be displaced downstream at such a rate that the surface 30*b* always shifts a previously unused upstream portion of cushioning material. However, the feed pitch setting also allows the user to reduce the feeding pitch to feed the cushioning material at a pitch where part of the punched marks may overlapped with a portion of previously punched marks. Further, the feed pitch may be adjusted according to the size or type of the punches 17. The perforation head 4 may include a plurality of the punches 17 and the pitch per size/type of the punches 17 may be recorded. By doing this, the feed pitch can be automatically switched in accordance with the punch 17 that is to be used, when a particular punch 17 is selected to be used. When the leather sheet is shifted to a subsequent process such as an embroidery after the completion of the perforation process, the leather sheet may be moved below the embroidery head 3 while being held in the holder frame 14 and in turn the embroidery process may be carried out.

As described-above, the embroidery sewing machine main body 1 according to the first embodiment has following effects. The tape-like feed mechanism 8 (cushioning material feed mechanism) may help in reducing wastage of tape-like cushioning material H used, because the tape-like cushioning material H with a broader width than the processing area of at least the punches (perforation tools) 17 is fed wherein its position is displaced from upstream to downstream by action of the motor 40 as described above, upon the vertically reciprocating motion of the punches 17. Further, deterioration of the reliability of the perforation process due to irregularity caused by the punched mark when perforating a workpiece may also be reduced because the tape-like cushioning material H that has an already punched mark is fed downstream as subsequent punches perforate the workpiece. In other words, due to the rate of feeding, an optimal rate may be obtained such that wastage may be saved, while the perforation quality may be maintained in a consistent manner by always being able to move unmarked, unperforated upstream cushioning material downstream to where the perforation is being performed. Further, the leather sheet (workpiece) after the perforation process may be easily transferred to a subsequent process such as embroidery as described above since the tape feed mechanism 8 operation is compartmentalized, wherein it is configured to feed the tape-like cushioning material H separately from movement and operation of the leather sheet (workpiece), which is held in the holder frame 14. Furthermore, even when the replacement of the tape-like cushioning material H is necessitated during the perforation process, the tape-like cushioning material H can be replaced without removing the leather sheet from the holder frame 14, therefore, the replacement work efficiency may be improved. It may also be possible to prevent the machine from needing to be increased in size in the right/left direction since the tape feed mechanism 8 is configured to feed the tape-like cushioning material H from the front/rear direction. This is remarkable in the machine configured to have a plurality of the perforation heads 4.

The machine may further be prevented from increasing in size in the right/left direction since the tape feed mechanism 8 is configured such that the reel 54 around which the tape-like cushioning material H is wound, is supported along the front/rear direction to the lower frame 7 that supports the receiving base 6 below the perforation head 4.

The tape feed mechanism 8 (cushioning material feed mechanism) may include a feed portion 37 configured to feed the tape-like cushioning material H between the leather sheet (workpiece), which is held in the holder frame 14, and the upper surface of the receiving member 30*b*. The detecting device 56 (detection mechanism) is provided in the feed passage for feeding the tape-like cushioning material H from the reel 54 to the feed portion 37 via rollers 55, wherein the detecting device 56 serves to detect the feed condition of the tape-like cushioning material H by the weighted rotatable lever 58 (actuator) in accordance with the tension applied to the tape-like cushioning material H. In this way, it may be possible to determine whether the tape-like cushioning material H is stably fed or not in terms of being able to detect abnormal rotation, and it may also be possible to determine whether the tape-like cushioning material is completed and needs replacement.

The tape feed mechanism 8 is of a compact construction since the feed portion 37 is built into the receiving base 6.

Successive perforation processes may be performed in an automated manner since the control means is provided to control the holder frame 14 to move in the two-dimensional direction in response to the command based on data stored in advance.

The receiving base 6 may include a receiving plate 36 having a window hole 36*a* through which the punch 17 can be inserted. The receiving plate 36 is provided with a guide portion 36*b* on its underside, wherein said guide portion 36*b* serves to restrict moving of the tape-like cushioning material H in the width direction due to the window hole 36*a* and also serves to restrict the removal of the tape-like cushioning material H from the window hole 36*a*. Therefore, the tape-like cushioning material H may be stably fed because it is restricted from moving in the width direction as well as restricted from removing from the window hole 36*a*.

The guide portion 36*b* may smoothly feed the tape-like cushioning material H from the receiving plate 36 to the feed portion 37 since the guide portion 36*b* is configured by the direction of its curve to guide the tape-like cushioning material H to the feed portion 37, wherein its convex curved surface on the underside of receiving plate 36 directs the material H to the feed portion as the punches 17 may penetrate through the window hole 36*a* and contact the receiving member 30*b*.

Collective waste of the amount of tape-like cushioning material H being fed may be optimally reduced since the tape-like feed mechanism 8 is configured to be able to adjust the feed pitch of the tape-like cushioning material H. Such a structure allows for the work efficiency of the perforation process to be improved since the feed amount and pitch can be switched in accordance with the shape, surface area etc. of the punches 17 (perforation tools) to optimize conservation of fed material H while maintaining perforation consistency.

The perforation head 4 may include a plurality of the punches 17 with various planar shapes. The tape feed mechanism 8 may be configured such that the feed amount of the tape-like cushioning material H can be automatically adjusted in response to the type of various punches 17 selected to be used for perforation. Therefore, both the flexibility of the perforation forming and the work efficiency of the perforation process itself can be improved since the feed amount of the tape-like cushioning material H can be automatically configured depending on the choice of various punches 17.

If the embroidery sewing machine main body 1 includes a perforating apparatus having the perforation head 4 and the embroidery head 3 having a needle attached to the vertically reciprocating needle bar and its leading end, the sewing machine can be configured to be able to smoothly carry out both the perforation process and the embroidery process.

Second Embodiment

Hereinafter, the second embodiment will be described with reference to FIGS. 12 to 14. The same reference numerals will be assigned to the same structural components in common with the first embodiment, and detailed description of said components will be omitted.

Figure 12:
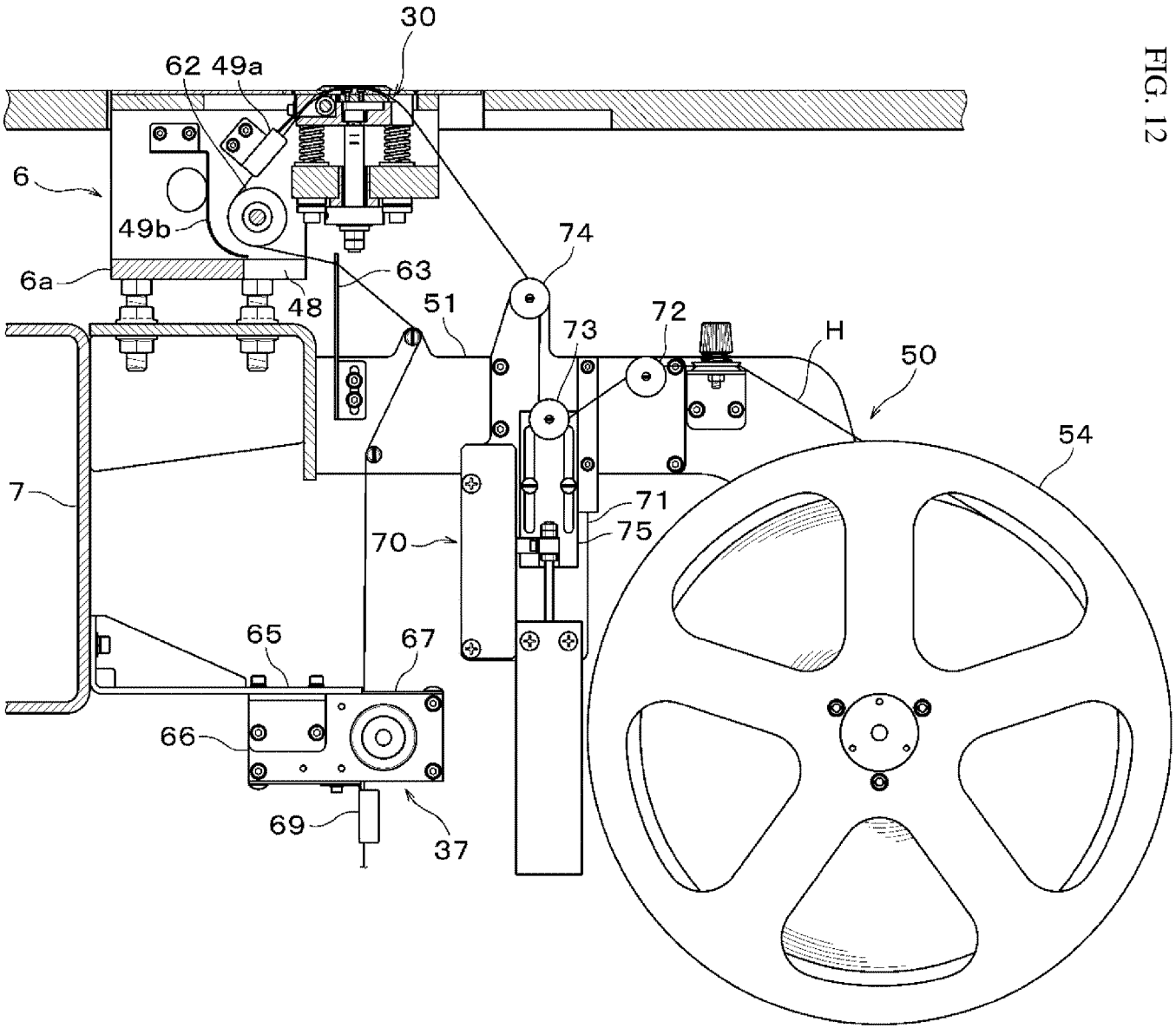
FIG. 12 is a side view of a receiving base and a tape feed mechanism (cushioning material feed mechanism) according to a second embodiment.
Figure 13:
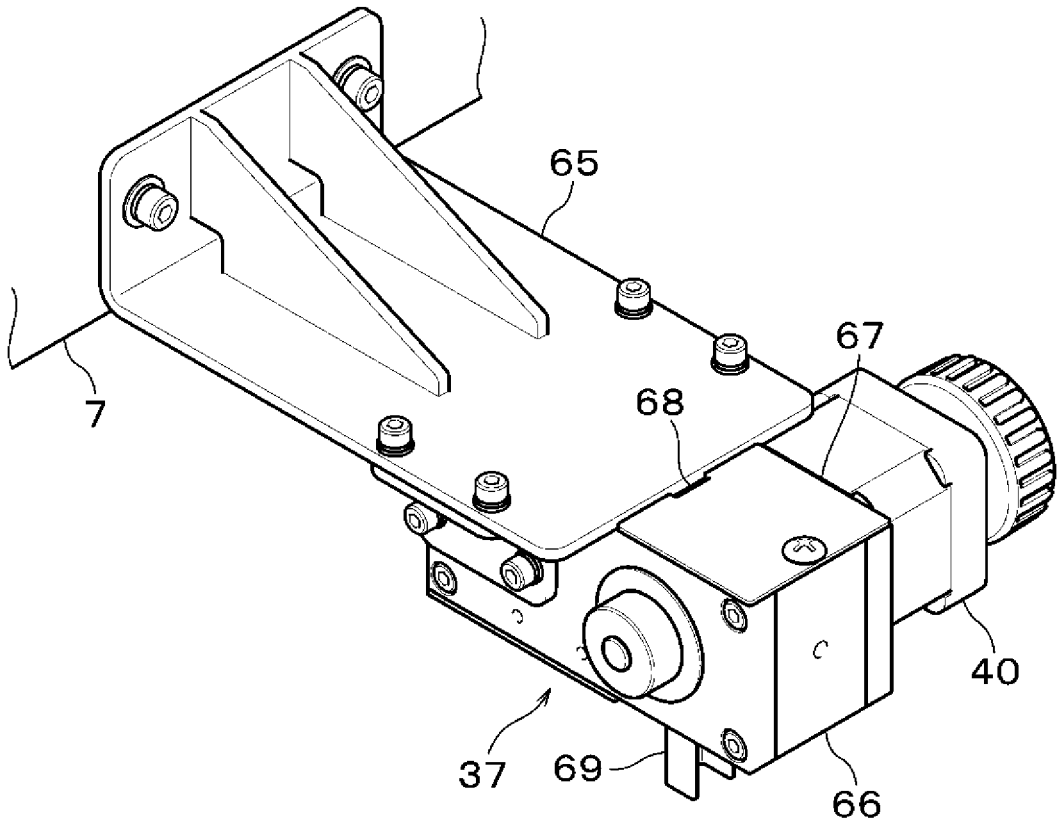
FIG. 13 is a perspective view of a feed portion of the tape feed mechanism (cushioning material feed mechanism) according to the second embodiment.
Figure 14:
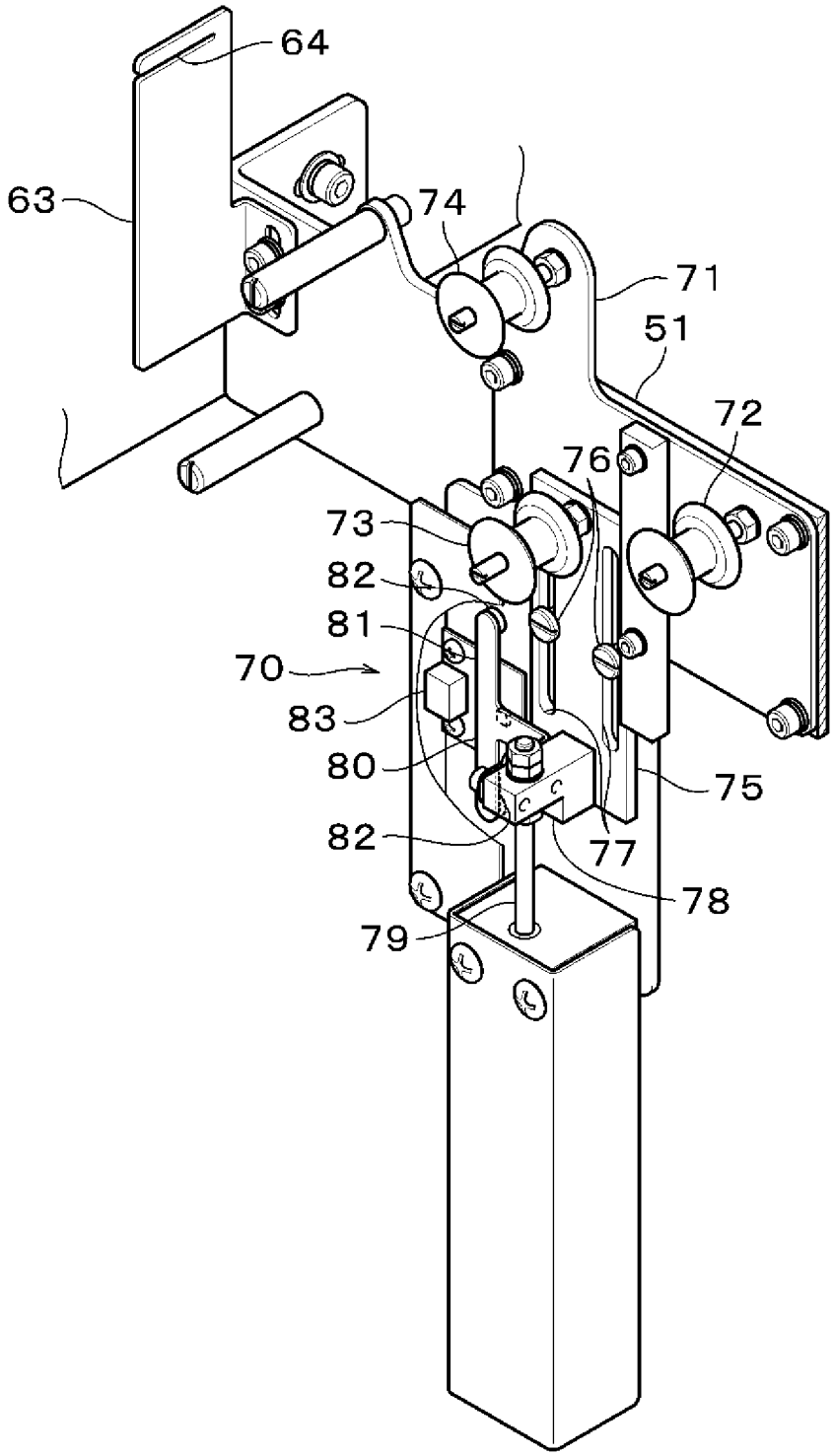
FIG. 14 is a perspective view of a detecting device of the tape feed mechanism (cushioning material feed mechanism) according to the second embodiment.

In the second embodiment, as shown in FIGS. 12 to 14, the feed portion 37 is disposed outside of the receiving base 6. Depending on the type of the workpiece used, such as a leather sheet, severe fiber fuzzing may be caused on the back surface. When such a leather sheet is subjected to a perforation process, particularly if the material is adhesive, the fiber swarf on the back surface of the leather sheet may adhere to the tape-like cushioning material H which may cause the fiber swarf to remain in the feeding portion 37 during the perforation process. The second embodiment differs from the first embodiment in that the maintenance is facilitated by providing the feed portion 37 to the outer side of the receiving base 6.

The receiving base 6 according to the second embodiment is provided with guides 49*a* and 49*b* as well as guide rollers 62 behind the punching base 30. These guides 49*a*, 49*b* and guide rollers 62 collectively serve to guide the tape-like cushioning material H toward the outlet 48 provided in the bottom plate 6*a* of the receiving base 6. Further, a support member 63 is provided in front of the outlet 48 to lift the tape-like cushioning material H so as to prevent the tape-like cushioning material H from hanging down and/or touching the bottom plate 6*a*. The support member 63 is fixed on a support base 51 for a reel support portion 50 such that the vertical position thereof can be adjusted, and is formed with a slit 64 at its upper end through which the tape-like cushioning material H is inserted.

The feed portion 37 is located below the receiving base 6 and is built within a box 66. The box 66 is fixed to the support base 65 that is forwardly protruding from the lower frame 7. A cover plate 67 for the box 66 is formed with an inlet 68 for the tape-like cushioning material H. A bottom front side of the box 66 is opened as an outlet for the tape-like cushioning material H and is provided with a guide 69. The feed portion 37 within the box 66 comprises a drive roller 41 (not shown) and a driven roller 45 (not shown) that are axially supported as an extension of the shaft of the motor 40 similarly to the first embodiment and, wherein the movement of the motor with the consequent movement of the drive roller 41 and driven roller 45 is configured to convey the tape-like cushioning material H below the box 66 in accordance with the rotation of the drive roller 41.

Hereinafter, the detecting device 70 for the reel support portion 50 will be described. The detecting device 70 serves to detect the completion of feed of the tape-like cushioning material H wound around the reel 54 and/or the abnormal rotation of the reel 54 in a manner similar to the first embodiment. The detecting device 70 is provided on an attachment plate 71 which is fixed to the support base 51 for the reel support portion 50. The attachment plate 71 is provided with: a first roller 72 (inverting member) allowing the tape-like cushioning material H fed from the reel 54 to be downwardly directed, a second roller 73 allowing the tape-like cushioning material H inverted at the first roller 72 to be inverted again in an upward direction, and a third roller 74 allowing the tape-like cushioning material H inverted at the second roller 73 to be directed toward the receiving base 6. The first roller 72 and the third roller 74 are axially supported at fixed predetermined positions of the attachment plate 71 in a rotatable manner while the second roller 73 is axially supported to the upper portion of a movable body 75 in a rotatable manner. The movable body 75 includes two guide grooves 77 comprising vertically elongated holes into each of which a screw 76 fixed on the attachment plate 71 is engaged so that the movable body 75 is supported in a vertically movable manner along the guide grooves 77. As a result, the movable body 75 is vertically slidable due to the action applied to the second roller 73. When the tensioned is applied to the tape-like cushioning material H, the second roller 73 is lifted to move the movable body 75 upward. The movable body 75 is lowered under to its own weight when the tape-like cushioning material H is loosened or completely used up.

A guide shaft 79 configured to allow the movable body 75 to linearly move vertically via a connection block 78 is attached to the lower portion of the movable body 75, and a displacement member 80 (actuator) having a rearwardly oriented T-shaped is attached to its lateral side. The displacement member 80 includes magnets 82 at each of the upper and lower leading ends of a vertical portion 81 and is linearly movable in a vertical direction integral with the movable body 75. Further, a magnetic sensor 83 for detecting the magnetism caused by the magnets 82 may be provided in a position opposing the vertical portion 81 of the displacement member 80.

Because of these configurations, the detecting device 70 may operate as follows. When the tape-like cushioning material H wound around the reel 54 is completely fed, the displacement member 80 (actuator) is lowered under the weight of the movable body 75. Because the actuator being lowered means the vertical portion 81 is also lowered. As a result, the magnet sensor 83 detects the magnet 82 on the upper end of the vertical portion 81 and accordingly detects running out of the tape-like cushioning material H. If instead the abnormal condition is caused where the reel 54 has failed to rotate for some reason, the tape-like cushioning material H is tensioned thereby the second roller 73 is lifted. The displacement member 80 is also lifted with the movable body 75 so that magnet 82 of the lower end of the vertical portion 81 of the displacement member 80 is detected by the magnetic sensor 83, and the corresponding abnormality in rotation of the reel 54, instead of running out of the tape-like material H in the case of the upper magnet 82, can be detected.

The tape feed mechanism 8 (cushioning material feed mechanism) may include a feed portion 37 configured to feed the tape-like cushioning material H between a leather sheet (workpiece) held in the holder frame 14 and the upper surface of the receiving member 30*b*. A detecting device 70 (detection mechanism) is provided on the feed passage of the tape-like cushioning material H that is fed from the reel 54 to the feed portion 37, wherein the detecting device 70 is configured to detect the feed condition of the tape-like cushioning material H by the displacement member 80 (actuator) which is slidably moved in accordance with the tension applied to the tape-like cushioning material H. This configuration may determine whether the tape-like cushioning material H is stably fed or not, distinct from another determination of whether the tape-like cushioning material H has run out.

The detecting device 70 may include a second roller 73 for guiding the tape-like cushioning material H, a movable body 75 that axially supports the second roller 73 in a rotatable manner and slidably moves with the second roller 73 in accordance with the level of the tension applied to the second roller 73, a displacement member 80 (actuator) supported to the movable body 75, and a magnetic sensor 83 for detecting the slide motion of the displacement member 80. Therefore, it is possible to determine whether the tape-like cushioning material H is stably fed by detecting whether the second roller 73 for guiding the tape-like cushioning material H is positioned in a proper position when the tape-like cushioning material H is fed from the reel 54 to the feed portion 37.

The displacement member 80 moves upward as the second roller 73 is lifted when the tension is applied to the tape-like cushioning material H in response the abnormal rotation of the reel 54. Conversely the displacement member 80 moves downward due to the weight of the movable body 75 as the cushioning material wound around the reel 54 is entirely fed or loosened, resulting in little to no tension being applied to the cushioning material H. Therefore, the displacement member 80 (actuator) may detect the delay or stop of feeding the tape-like cushioning material H due to the rotational abnormality of the reel 54 or the completion of feeding of the tape-like cushioning material H wound around the reel 54 or loosening of the tape-like cushioning material H in accordance with the upward or downward motion of the movable body 75 which supports the second roller 73.

Another Embodiment

According to the first and second embodiments 1 and 2, an example was shown in which the sewing process with the embroidery thread is carried out after the perforation process since they have shown the embroidery sawing machine main body as an example. However, according to another embodiment, it is not necessary to carry out the embroidery sewing process after the perforation process but a decoration process method may be selected in which only the perforation process is performed without carrying out the embroidery swing process after the perforation process. In this case, various punches 17 with different sizes and/or shapes may be set at each of the reciprocation bars 15 and the control means may selectively control each of the reciprocating bars 15 so as to be able to form various types of the perforation decorative patterns (decorative patterns formed only by the perforation patterns).

In the first and second embodiments, only one pair of the embroidery heads 3 and the perforation heads 4 are provided, however, this is not limited to and in another embodiment, a plurality of the embroidery heads 3 and perforation heads 4 may be provided. As another embodiment, a perforating apparatus merely with a plurality of perforation heads 4 may be provided.

In the second embodiment, the displacement member 80 and the movable body 75 are illustrated to be separated members as an actuator, however, the displacement member 80 and the movable body 75 may be integrated to comprise an actuator.

Although the exemplary embodiments according to the present disclosure have been described above, the perforating apparatus and the embroidery sewing machine with the perforating apparatus of the present disclosure are not limited to the present embodiments but may be applied in various other forms and combinations.

The invention claimed is:

1. A perforating apparatus comprising:

a perforation head including a vertically reciprocating bar and a perforation tool provided at a lower leading end of the bar;

a receiving base arranged below the perforation head, wherein the receiving base includes a receiving member configured to receive the perforation tool which is lowered in accordance with lowering movement of the bar;

a holder frame configured to support a workpiece in an expanded state between the perforation tool and the receiving base in a planar direction orthogonal to the vertical direction of the bar, the holder frame being configured to be controlled to move in two-dimensions along said planar direction such as a front/rear direction of the plane direction and a right/left direction of the plane orthogonal to the front/rear direction; and a cushioning material feed mechanism configured to feed a tape-like cushioning material having a wider width than at least a processing area of the perforation tool, where the mechanism feeds said material from the front/rear direction, between the workpiece supported in the holder frame and an upper surface of the receiving member, wherein the mechanism shifts cushioning material positioned upstream of the receiving member, downstream to the location of the receiving member, at a rate commensurate with the vertically reciprocating motion of the perforation tool.

2. The perforating apparatus of claim 1, wherein the cushioning material feed mechanism includes a reel where the cushioning material is wound around said reel, and wherein the reel is supported on a frame designed to also support the receiving base such that the reel is supported so as to rotate and direct cushioning material in the front/rear direction below the perforation head.

3. The perforating apparatus of claim 1, wherein the cushioning material feed mechanism includes a feed portion configured to feed the cushioning material between the workpiece supported in the holder frame and the upper surface of the receiving member, and wherein a detection mechanism is provided within a feed passage of the cushioning material from a reel to the feed portion, wherein said detection mechanism includes an actuator, and is configured to detect the feed condition of the cushioning material by said actuator, wherein said actuator is displaced under its own weight in accordance with tension applied to the cushioning material.

4. The perforating apparatus of claim 1, wherein the feed portion is built within the receiving base.

5. The perforating apparatus of claim 3, wherein the detection mechanism includes:

an inverting member including a roller configured to guide the cushioning material;

a movable body configured to axially support the inverting member in a rotatable manner, the movable body being configured to slidably move together with the inverting member in response to level of the tension applied to the inverting member from the cushioning material;

a displacement member supported on the movable body; and a sensor configured to detect slide motion of the inverting member.

6. The perforating apparatus of claim 5, wherein the displacement member is configured to move upward as the inverting member is lifted when the tension is applied to the cushioning material due to abnormal rotation of the reel, and wherein the displacement member is configured to move downward due to weight of the movable body as the cushioning material wound around the reel is completely fed or loosened while the tension is not applied to the cushioning material.

7. The perforating apparatus of claim 1, wherein the receiving base includes a receiving plate with a window hole into which the perforation tool can be inserted, and wherein a guide surface is provided on the underside of the receiving plate, wherein the guide surface is configured to restrict the cushioning material from moving relative to the window hole in the width direction and further restricts the cushioning material from being removed out of the window hole.

8. The perforating apparatus of claim 7, wherein the guide surface includes a convex curved surface on the underside of the receiving plate, by which the guide surface contacts the cushioning material to direct said material to the feed portion.

9. The perforating apparatus of claim 1, wherein the cushioning material feed mechanism is configured to be able to switch the rate at which material is being fed, or the feed pitch of the cushioning material.

10. The perforating apparatus of claim 1, wherein the perforation head includes a plurality of the perforation tools with various planar shapes, and wherein the cushioning material feed mechanism is configured to be able to switch the feed pitch of the cushioning material in accordance with the particular perforation tools being used.

11. An embroidery sewing machine comprising the perforating apparatus of claim 1, and an embroidery head including a vertically reciprocating needle bar and a sewing needle provided at a leading end of the needle bar.

12. The perforating apparatus of claim 3, wherein said actuator is made of a bifurcated construction.

13. The perforating apparatus of claim 3, wherein said actuator is structurally made to be in constant contact with the cushioning material, and is tensioned by said cushioning material.

14. A perforating apparatus comprising:

a perforation head including a plurality of vertically reciprocating bars, perforation tools at the lower leading end of the bar, and a perforation blade at the lower leading end of each perforation tool;

a receiving base arranged below the perforation head, wherein the receiving base includes a circular receiving plate with a window hole at its center through which the perforating blade of a perforating tool from the perforating head may be inserted, wherein the receiving plate is overlaid over top of a receiving member with an downwardly inclined arc surface, wherein the receiving member is configured to receive the perforation blade of the perforation tool through the window hole of the circular receiving plate;

a holder frame configured to support a workpiece in an expanded state between the perforation tool and the receiving base in a planar direction orthogonal to the vertical direction of the bar, the holder frame being configured to be controlled to move in two-dimensions along said planar direction such as a front/rear direction of the plane direction and a right/left direction of the plane orthogonal to the front/rear direction via motorized drives driven by a controller; and a cushioning material feed mechanism configured to feed a tape-like cushioning material having a wider width than at least a processing area of the perforation tool, where the mechanism feeds said material from the front/rear direction, between the workpiece supported in the holder frame and an upper surface of the receiving member, wherein the mechanism shifts cushioning material positioned upstream of the receiving member, downstream to the location of the receiving member, at a rate commensurate with the vertically reciprocating motion of the perforation tool.

15. The perforating apparatus of claim 14, wherein the cushioning material feed mechanism includes a reel where the cushioning material is wound around said reel, and wherein the reel is supported on a frame designed to also support the receiving base such that the reel is supported so as to rotate and direct cushioning material in the front/rear direction below the perforation head, wherein the cushioning material feed mechanism includes a feed portion configured to feed the cushioning material between the workpiece supported in the holder frame and the upper surface of the receiving member, and wherein a detection mechanism is provided within a feed passage of the cushioning material from the reel to the feed portion, wherein said detection mechanism includes an actuator, and is configured to detect the feed condition of the cushioning material by said actuator, wherein said actuator is displaced under its own weight in accordance with tension applied to the cushioning material.

16. The perforating apparatus of claim 15, wherein the detection mechanism includes:

an inverting member including a roller configured to guide the cushioning material;

a movable body configured to axially support the inverting member in a rotatable manner, the movable body comprising two vertically elongated grooves via which the movable body may collectively be vertically slidable with the inverting member, in response to level of the tension applied to the inverting member from the cushioning material;

a displacement member supported on the movable body; and a sensor configured to detect slide motion of the inverting member.

17. The perforating apparatus of claim 16, wherein the displacement member is configured to move upward as the inverting member is lifted when the tension is applied to the cushioning material due to abnormal rotation of the reel, and wherein the displacement member is configured to move downward due to weight of the movable body as the cushioning material wound around the reel is completely fed or loosened while the tension is not applied to the cushioning material.

18. The perforating apparatus of claim 17, wherein the displacement member is a T-shaped member oriented 90 degrees counter-clockwise.

19. The perforating apparatus of claim 18, wherein the displacement member comprises a magnetic along the vertically elongated portion of the T-shape, at the upper and lower ends, wherein the detection mechanism comprises a magnet sensor.

20. The perforating apparatus of claim 17, wherein a cylindrical elongated vertical shaft extends from the bottom of the moveable body so as to allow the movable body to linearly move in a vertical direction via a connection block.

* * * * *